United States Patent [19]

Fisher

[11] 4,228,822

[45] Oct. 21, 1980

[54] STREAM THROTTLE

[75] Inventor: Glen W. Fisher, Bellevue, Wash.

[73] Assignee: Technovators, Inc., Seattle, Wash.

[21] Appl. No.: 940,989

[22] Filed: Sep. 11, 1978

Related U.S. Application Data

[63] Continuation of Ser. No. 795,419, May 9, 1977, abandoned.

[51] Int. Cl.[3] ..... D03D 39/20

[52] U.S. Cl. ..... 138/46; 222/564; 366/178

[58] Field of Search ..... 222/545, 547, 145, 544, 222/564, 559, 510, 518, 501; 138/45, 46; 141/286, 105; 251/124, 121, 122, 118; 366/178, 336

[56] References Cited

U.S. PATENT DOCUMENTS

| | | | |
|---|---|---|---|
| 713,099 | 11/1902 | Hoepner | 222/547 X |
| 1,224,822 | 5/1917 | Williams | 222/559 X |
| 1,241,680 | 10/1917 | Thalman | 222/545 X |
| 2,588,555 | 3/1952 | Molloy | 138/43 |
| 2,652,175 | 9/1953 | Davis | 222/510 |
| 3,098,637 | 7/1963 | Baustian | 251/122 |
| 3,204,832 | 9/1965 | Barber | 222/246 |
| 3,347,534 | 10/1967 | Dawson | 259/180 |
| 3,589,560 | 6/1971 | Wilcox | 222/559 |

FOREIGN PATENT DOCUMENTS

| | | | |
|---|---|---|---|
| 701396 | 1/1941 | Fed. Rep. of Germany | 251/122 |
| 2023592 | 11/1971 | Fed. Rep. of Germany | 222/564 |
| 1092220 | 11/1967 | United Kingdom | 222/518 |

*Primary Examiner*—Harry N. Haroian
*Attorney, Agent, or Firm*—Dowrey & Cross

[57] ABSTRACT

The stream throttle includes a movable closure member having an inclined upstream surface and a parabolic downstream surface, an orifice which is throttled by the downstream surface, and an inclined entry surface extending upstream from the orifice in spaced relation to the downstream surface. The entry and downstream surfaces provide a flow control zone which terminates adjacent the orifice. These surfaces, together with the upstream surface, maintain material flow toward and through the control zone uniform, with minimum velocity gradients. The parabolic downstream surface outline causes orifice area and hence flow capacity to vary on a linear basis during movement of the closure member with respect to the orifice. In another disclosed embodiment, the upstream surface is formed by a stationary diverter member within which the closure member is insertable for stop-start flow control. The stream throttle may be used to provide a mass flow variable orifice for linear volumetric control of particulate material flow rates.

7 Claims, 5 Drawing Figures

STREAM THROTTLE

This is a continuation of application Ser. No. 795,419, filed May 9, 1977, now abandoned.

BACKGROUND OF THE INVENTION

This invention relates to methods and apparatus for controlling material flow. One application of the invention illustrated and described herein relates to a mass flow variable orifice for close volumetric control of particulate solids such as cereal, grains or other granular materials discharged from a solid particulate material blender from hoppered bin bottom. The invention, however, may be utilized in other applications and environments.

Volumetric control of grain and product rates in most milling installations heretofore has been accomplished by slide gates, mass compensating powerless feeders, or powered feeders. Slide gates are low in cost and, hence, tend to be the most widely used control devices; however, in most practical applications, slide gates do not offer acceptable accuracy and tend to choke readily. Powerless feeders offer greater accuracy, with increased cost, but present undesirable calibration and sanitation problems. Powered feeders offer still higher accuracy at correspondingly increased cost yet pose uneconomical reliability and service problems. Still other control devices utilizing gravimetric feeding and scaling techniques offer even higher accuracy at substantially greater cost.

Cost heretofore has been the predominate factor in the selection of volumetric grain control devices and, hence, slide gates find almost universal application in grain milling installations. In many practical applications, however, a slide gate provides unacceptable or uneconomical flow control because flow instabilities make it exceedingly difficult to maintain the slide gates at an optimum opening cross-sectional area. For these and other reasons, therefore, flow control commonly is accomplished manually on the basis of a visual inspection of the actual flow conditions downstream of the slide gate, or on the basis of material requirements of downstream milling apparatus. Consequently, the flow rate obtained tends to fluctuate as the slide gate is adjusted manually in an attempt to optimize flow conditions, or the slide gate is left open at a less than optimum cross-sectional area; therefore, the downstream milling apparatus must be operated on the basis of the mean or minimum flow fluctuations obtainable. This, of course, leads to uneconomical operation of the downstream milling apparatus with resultant uneconomical reduction in overall capacity of the milling installation.

SUMMARY OF THE INVENTION

This invention overcomes or substantially mitigates these and other problems associated with prior particulate material flow control apparatus by providing an apparatus and method for controlling particulate material flow which offer the simplicity and economy heretofore associated with slide gates, together with the accuracy of powered feeders and other more costly control devices. A control zone terminates adjacent a location at which flow rate control is effected on the basis of variable minimum area. Uniform or mass flow is established in the control zone, as well as upstream of the control zone, so that the rate of change of velocity of material is minimized as it approaches the minimum area. Highly uniform flow without or with minimum shear lines, dead stock, turbulence and/or velicity gradients therefore is obtained.

Thus, it will be appreciated from the foregoing summary that this invention provides an apparatus and method which afford highly effective particulate material flow control. By providing uniform flow of material toward and through the control zone, it is possible to obtain calibration accuracy, rate stability, choke resistance and other advantages while controlling minimum area by simple orifice restriction or throttling. Preferably, the latter is accomplished by selectively restricting the area of an orifice located adjacent the downstream terminus of the control zone by an appropriate flow restricting member which, when moved with respect to the orifice, produces a predetermined change in orifice cross-section. In one preferred embodiment, this change is conducted on a linear basis in equal increments of orifice area using two opposed relatively movable surfaces, one parabolic in outline and the other conical in outline.

These and other features, objects and advantages of the present invention will become apparent in the detailed description and claims to follow taken in conjunction with the accompanying drawings in which like parts bear like reference numerals.

DETAILED DESCRIPTION OF THE DRAWINGS

Figure 1:
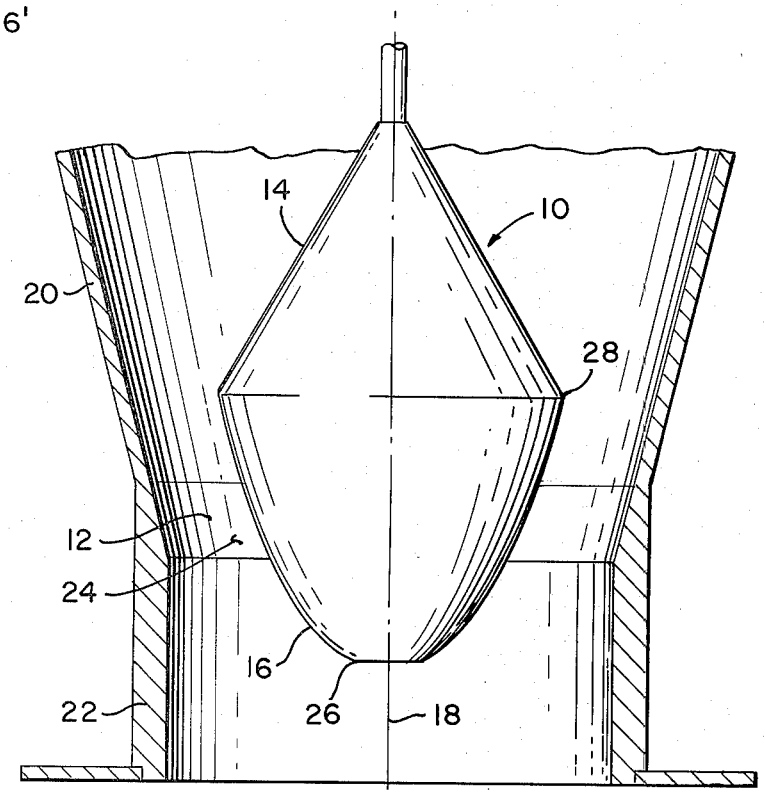
FIG. 1 is a vertical section of the stream throttle of this invention.

Referring to FIG. 1, the stream throttle according to this invention includes a movable closure member (generally referenced by numeral 10), an inclined entry surface 12, and a variable area orifice 24 located adjacent the downstream terminus of surface 12. In the illustrated example, surface 12 is of generally inverted frusto-conical outline. Member 10 includes an upstream surface 14 of a generally conical cross-sectional outline and a downstream surface 16 of generally parabolic cross-sectional outline. It is surface 16 which restricts or throttles orifice 24, as will be described presently. Member 10 is mounted for reciprocative movement along a rectilinear path which, in this example, coincides with the longitudinal axis 18 of the flow passage extending from an upstream inverted conical section 20 to a downstream cylindrical section 22.

Surface 16 and surface 12 form a control zone therebetween, toward and through which particulate material flows under uniform flow conditions. The portions of these surfaces adjacent the downstream terminus of the control zone form orifice 24 and therefore control flow rate in the control zone on the basis of orifice area. In the illustrated example, the orifice 24 coincides with a conical projection from the downstream terminus of surface 12 toward surface 16 in generally perpendicular relation therewith.

To maintain uniform flow of material flowing toward and through the control zone, mass flow first is established upstream of the control zone by forming surface 14 of a slope which exceeds the angle of repose of the particulate material being handled. These conditions are maintained as far as possible within the control zone itself by forming surfaces 12 and 16 such that the length and disposition of the control zone above orifice 24 are sufficient to minimize the rate of change of velocity, or velocity gradient, as the material approaches orifice 24. Consequently, the material, as it flows toward and through the control zone, is effectively prepared for the flow limitation applied by orifice 24. Above the orifice, therefore, dead stock, shear lines, tumbling, turbulence and other flow irregularities are eliminated or substantially minimized. Below the orifice, of course, the material enters free fall but, by then, the throttling or control objectives have been accomplished.

To control orifice area while providing uniform flow in the control zone, surface 16 is formed as a paraboloid of revolution symmetrically disposed with respect to axis 18 and orifice 24. Surface 12 likewise is formed as an inverted frusto-conical surface of revolution, and extends upstream from orifice 24, as shown (FIG. 1). Selective positioning of surface 16 with respect to surface 12 along axis 18 therefore will cause the orifice cross-sectional area to change in predeterminable amounts, as depicted schematically in FIG. 2. In the illustrated case wherein surface 16 is parabolic in outline, the orifice area can be changed in equal increments of area, or be changed on a linear basis, by moving member 10 (and hence surface 16) correspondingly.

Figure 2:
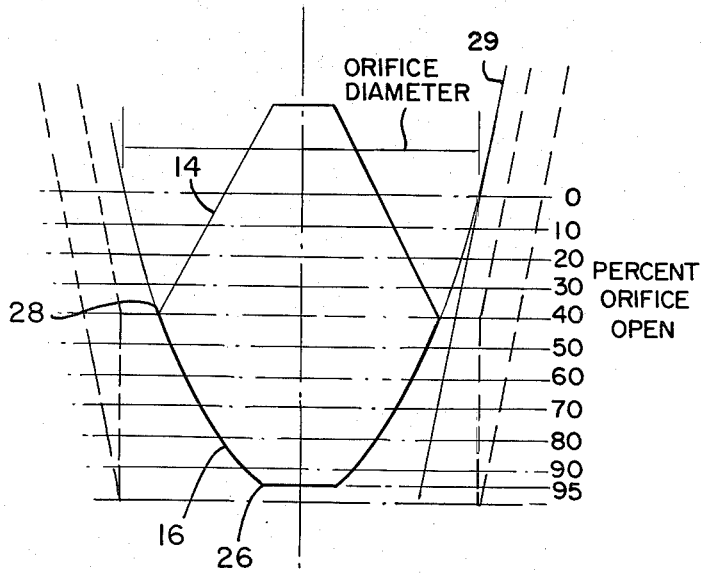
FIG. 2 is a schematic outline of the closure member of the FIG. 1 stream throttle.
Figure 5:
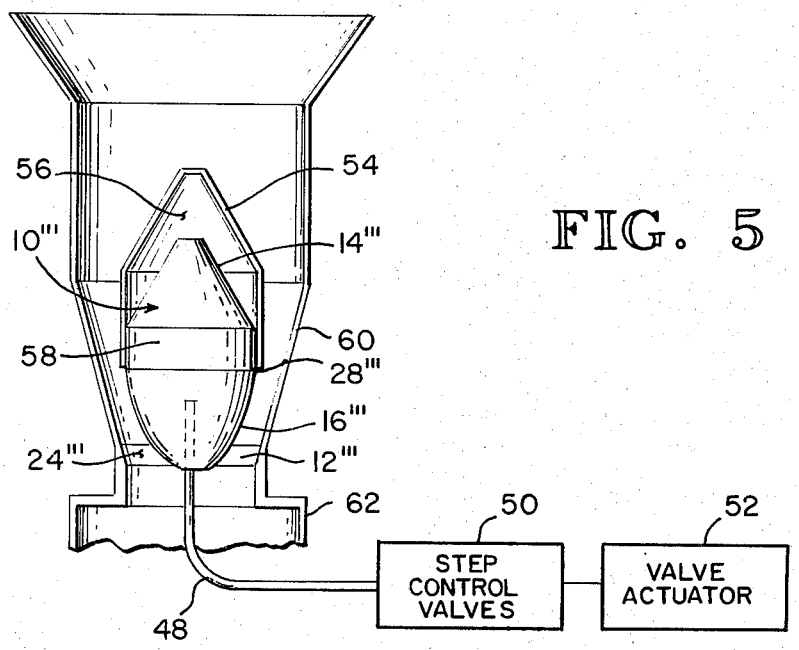
FIG. 5 is a schematic diagram of a particulate material discharge system including a modified form of the FIG. 1 stream throttle.

Referring now in particular to FIG. 2, the configuration of surface 16 is selected by first determining the orifice diameter required to pass a certain material capacity when restricted by a portion of surface 16 having a slope corresponding to the angle of repose of the material being controlled. This determines the opening side limitation of the orifice area control range and hence the downstream length of surface 16. In the example, the curved apex portion of surface 16 is terminated at a location 26 corresponding to 95% opening. Acceptable flow rate control therefore will terminate if member 10 is elevated such that location 26 is upstream of the orifice. Next, the closing side limitation of the orifice area control range and hence the upstream length of surface 16 are selected. In FIG. 2, a control range of 95:40 percent orifice area, or about 2:1, has been selected. In this example, the upper terminus 28 of surface 16, when positioned at a location coinciding with orifice 24, forms a 40% open orifice. To obtain different control ranges, of course, surface 16 could be lengthened or shortened, as the case may be. FIG. 5 illustrates another example in which surface 16 is lengthened to the point that the diameter of the closure member at the upper terminus of surface 16 corresponds to the orifice diameter.

Referring again to FIG. 2, the configuration of surface 12 is selected by first taking a tangent (referenced by numeral 29 in FIG. 2) to surface 16 projected to a diameter equal to the orifice diameter. The slope of surface 12 corresponds to the slope of tangent 29. The length of surface 12 along the control zone is sufficient to obtain the control zone flow conditions described hereinabove. In practical grain handling applications, a length of 1 inch is sufficient to obtain and maintain such flow conditions. The length of surface 12, of course, may vary somewhat, depending upon orifice diameter, nature of the particulate material and other factors. As will now be appreciated, the construction and arrangement of surfaces 12, 14 and 16 may vary, depending upon the particulate material being handled, control range, rate of change of orifice area, and other factors. The illustrated configurations of these surfaces is therefore merely illustrative and not limiting.

Figure 3:
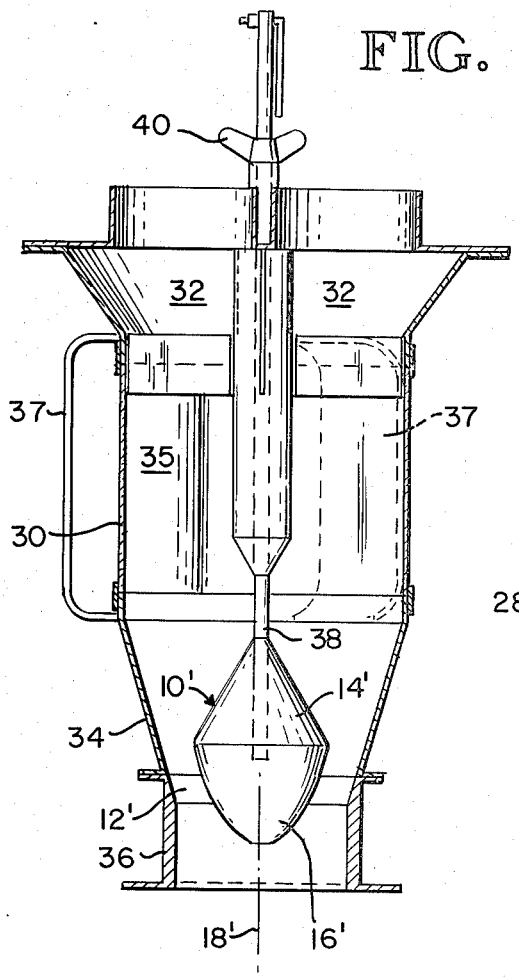
FIG. 3 is a vertical section of a solid particulate material blender equipped with the FIG. 1 stream throttle.

Referring now to FIG. 3, the stream throttle of this invention may be utilized in a solid particulate material blender to control the rate at which material is discharged therefrom. The FIG. 3 blender includes a gravity discharge passageway 35, together with a plurality of segregated compartments extending into and terminating open-end within the gravity discharge passageway. These segregated compartments are formed by spaced apart divider plates 32. The streams of material to be blended are fed into respective segregated compartments and are combined into a common stream in the passageway 35 under laminar mass flow conditions at a point of combination which coincides with the terminus of the compartments. A mass flow hopper 34 restricts flow through the passageway 35 to a rate less than the combined maximum flow rates of the segregated streams while the stream throttle controls flow rates below the rate established by hopper 34. Passageway 35 further includes an elongated section of at least a minimum length and of substantially uniform cross-sectional area commencing at the point of combination and extending downstream therefrom. This minimum length is greater than the distance between the hopper 34 and a critical point upstream thereof at which flow begins to be nonuniform across the elongated section. The FIG. 3 blender as thus far described is illustrated and described in further detail in the U.S. Pat. No. 3,575,321, the disclosure of which is hereby incorporated by reference. The FIG. 3 blender further includes a sight glass 30 surrounding passageway 35. Vertical load bearing members 37 are connected between and support plates 32 and hopper 34.

The stream throttle is mounted coaxially within hopper 34 adjacent the downstream face thereof. (Parts corresponding to those illustrated and described hereinabove are designated with the same reference numerals, primed.) In FIG. 3, entry surface 12' is machined from the upper edge portion of a flanged collar 36 which is secured to a mating flange on the lower edge of hopper 34, as shown (FIG. 3). Member 10' is mounted by the lower end of a threaded control rod 38 which is keyed to plates 32 in axial alignment with axis 18'. To maintain a uniform friction surface for contact with the particulate material, collar 36, rod 38 and hopper 34 may be fabricated of the appropriate material, such as stainless steel. Member 10' is formed of suitable abrasion resistant material such as an ultra high molecular weight (UHMW) synthetic resin.

To control flow rate, the position of member 10' along axis 18' is controlled by a screw actuator 40 located at the top of the blender and secured to rod 38. Rotation of rod 38 by actuator 40 causes member 10' to be raised and lowered with respect to the control zone orifice, as the case may be. Thus, it is possible, by appropriate selection of the screw thread associated with actuator 40, to move member 10' in predetermined vertical increments and, in so doing, to cause the orifice cross-sectional area to vary correspondingly. For example, the screw threads could be selected to afford a certain percentage linear variation in orifice area cross-sectional area, and hence flow capacity, with each complete revolution of actuator 40.

Figure 4:
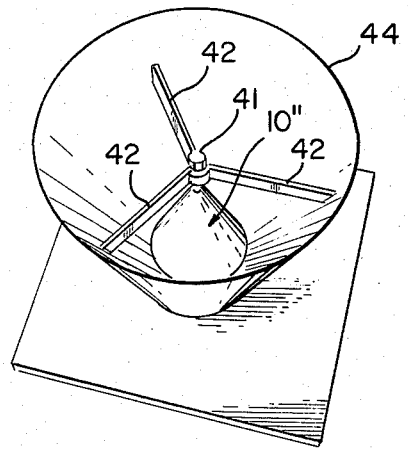
FIG. 4 is a top perspective of a bin bottom flow control attachment including the FIG. 1 stream throttle.

Referring now to FIG. 4, the stream throttle of this invention further may be utilized in a bin bottom attachment in place of or in combination with a conventional slide gate. (Parts corresponding to those illustrated and described in detail in FIGS. 1–3 are designated in FIG. 4 by like reference numerals, double primed, and are not further described herein.) In illustrated FIG. 4 construction, member 10″ is suspended by an adjustment screw 41 and three spider members 42 within an open-bottomed frusto conical member 44. This member is generally similar to the FIG. 3 collar 36 but is adapted to be mounted in underlying relation to a bin bottom outlet opening in place or downstream of a conventional slide gate. In those instances in which the attachment is mounted downstream of the slide gate, of course, the slide gate is maintained in its fully opened position so as not to affect proper operation of the stream throttle.

FIG. 5 depicts application of the stream throttle of this invention to an automated or semi-automated bin discharge control system wherein particulate material flow is stopped or completely shut off initially and thereafter is started or metered under appropriately controlled flow conditions. (Parts corresponding to those already illustrated and described are designated in FIG. 4 by the same reference numerals, triple-primed and are not further described.) Member 10‴ is mounted for reciprocative movement along a rectilinear path which coincides with the axis of orifice 24‴. Member 10‴ is selectively positioned and is movable by a cable operator 48 of conventional design. Operator 48 in turn is selectively operated by a step control valve system 50 made up of one, two or more staged control valves, together with a suitable valve actuator 52 operatively associated therewith. In the FIG. 5 example, the step control valve system 50 in combination with the valve actuator 52 may provide, by appropriate operation of the various staged control valves, a number of set positions of desired incremental spacings along the length of the control zone.

In the example of FIG. 5, the diameter of member 10‴ at upstream terminus 28‴ corresponds to the orifice diameter. Consequently, the FIG. 5 member 10‴ is capable of stopping or terminating flow through orifice 24‴ when positioned at its lowermost downstream position. To eliminate resistance from overlying particulate material as member 10‴ is elevated toward an open position from an initial position of full orifice closure, an upstream flow diverter 54 is mounted in coaxial relation to the orifice and member 10‴ at a suitable upstream location. Diverter 54 includes an upper surface of slope corresponding to that of surface 14‴ and provides an open-bottomed chamber 56. This chamber opens in a downstream direction and has an interior outline which substantially registers with the exterior outline of surface 14‴, as shown (FIG. 5). Thus, to elevate member 10‴ from its lowermost position in order to open orifice 24‴, member 10‴ may be raised within chamber 56 without resistance from the overlying particulate material.

In the FIG. 5 construction, the spacing between diverter 54 and surrounding conical section 60 should exceed the maximum spacing between surface 16‴ and surface 12‴ obtained when member 10‴ is positioned at its uppermost upstream position for maximum orifice opening. To this end, member 10‴ could include an intervening portion 58 of cylindrical outline and length sufficient to afford appropriate spacing of diverter 54 from section 60. Further, the diameter of downstream cylindrical section 62 also could be enlarged, as shown (FIG. 5). This enlargement should afford sufficient additional downstream flow capacity to offset any reduction in flow capacity imposed by operator 48 and/or its related support structure and, in this way, minimize the effects of this structure upon upstream flow rate control conditions.

Although several preferred embodiments of the invention have been illustrated and described herein, variations will become apparent to one of ordinary skill in the art. Accordingly, the invention is not to be limited to the specific embodiments illustrated and described herein, and the true scope and spirit of the invention are to be determined by reference to the appended claims.

The embodiments of the invention in which an exclusive property or privilege is claimed are defined as follows:

1. Apparatus for controlling flow of particulate material through an orifice, which apparatus comprises means for forming a hopper surface extending upstream from said orifice, and a flow control assembly located adjacent said orifice, said flow control assembly including an upstream surface, said upstream surface having means for directing particulate material toward said hopper surface upstream from said orifice and control zone forming means for forming a flow control zone immediately above said orifice in which the rate of increase in velocity of particulate material flow is minimized as the particulate material approaches said orifice, said control zone forming means including a downstream surface connected to said upstream surface, said downstream surface formed as a surface of revolution having a parabolic vertical cross-section, said downstream surface curving away from said hopper surface in vertical cross-section while being spaced from said hopper surface and means mounting said flow control assembly relative to said hopper surface to cause said downstream surface to extend partially through said orifice for maintaining uniform flow of particulate material from said hopper surface toward said orifice with the particulate material making essentially continuous contact with said downstream surface to minimize the rate of increase in velocity of particulate material as the particulate material flows toward said orifice.

2. The apparatus of claim 1 further comprising control means for moving said downstream surface with respect to the hopper surface and said orifice to selectively position said downstream surface at a plurality of positions with respect to said orifice to control the effective area thereof, said downstream surface having a length sufficient to maintain at least a portion of said downstream surface in opposed relation with the hopper surface when said downstream surface is positioned at any of said plurality of positions.

3. The apparatus of claim 2, wherein said orifice has a circular outline and said downstream surface is formed as a paraboloid of revolution about an axis which substantially coincides with the center of said orifice, the hopper surface being inclined at a slope which corresponds to the slope of said downstream surface projected to a diameter corresponding to the diameter of said orifice.

4. The apparatus of claim 2, wherein said downstream surface has an outline corresponding to the outline of said orifice and said downstream surface is of sufficient size to close said orifice when said downstream surface is located at a downstream position and wherein said flow control assembly further includes means mounted in fixed position with respect to the hopper surface for providing a cavity into which at least a portion of said downstream surface may be inserted to permit movement thereof toward an upstream position at which said orifice is opened.

5. The apparatus of claim 2 wherein said flow control assembly includes a movable member comprising said upstream surface, said movable member having a conical upper surface with a slope greater than the angle of repose of the particulate material.

6. An apparatus including a discharge passageway for blended particulate materials, blending means for introducing segregated streams of said particulate materials into the discharge passageway and combining the particulate materials into a common stream in the passageway at a point of combination, the passageway having an elongated section of at least a minimum length and of substantially uniform cross-sectional area commencing at the point of combination and extending downstream from the point of combination, and means downstream of the elongated section for restricting the flow therethrough to a rate less than the combined maximum flow rates of the segregated streams to obtain a uniform movement of cross-sectional segments of the solids at the point of combination, said minimum length being greater than the distance between the restricting means and a critical point upstream of the restricting means at which the flow begins to be nonuniform across the elongated section, the improvement comprising: means located downstream of the elongated section forming a hopper surface extending upstream from an orifice in communication with the elongated section, a member including a conical upper surface with a slope greater than the angle of repose of the solids and control zone forming means for forming a flow control zone immediately above said orifice in which the rate of increase in velocity of particulate material flow is minimized as the particulate material approaches said orifice, said control zone forming means including a lower surface having a parabolic vertical cross section, support means extending longitudinally through the discharge passageway and said restricting means for supporting said member with said upper surface facing upstream to direct particulate material toward said hopper surface upstream from said orifice, said lower surface facing downstream and extending through said orifice and spaced from said hopper surface such that particulate material will flow from said hopper surface under uniform flow conditions while the rate of increase in velocity of particulate material flow decreases as the particulate material approaches said orifice with essentially continuous contact of the particulate material with said lower surface, and adjustment means connected with said support means for causing said member to be moved with respect to said hopper surface and said orifice in a direction parallel to the longitudinal axis of the discharge passageway to selectively position said member at a plurality of positions with respect to said orifice in order to control the effective area of said orifice, said lower surface having a length sufficient to maintain at least a portion thereof in opposed relation with the hopper surface commencing at said orifice and continuing upstream to said hopper surface when said member is positioned at any of said plurality of positions.

7. The apparatus of claim 6, wherein said outlet has a circular outline and said lower surface is formed as a paraboloid of revolution about an axis which substantially coincides with the center of said outlet, the hopper surface being inclined at a slope which corresponds to the slope of said lower surface projected at a diameter corresponding to the diameter of said outlet.

* * * * *